US006119874A

United States Patent [19]

Anderson

[11] Patent Number: 6,119,874

[45] Date of Patent: Sep. 19, 2000

[54] SPACESAVER PRODUCT DISPLAY HANGER SYSTEM

[76] Inventor: Wayne Anderson, 65 Grove St., Northport, N.Y. 11768

[21] Appl. No.: 09/134,683

[22] Filed: Aug. 14, 1998

[51] Int. Cl.[7] ..... B42F 7/00

[52] U.S. Cl. ..... 211/57.1

[58] Field of Search ..... 211/57.1, 59.1, 211/94.01, 106; 248/220.31, 220.41, 220.42, 220.43

[56] References Cited

U.S. PATENT DOCUMENTS

| | | | |
|---|---|---|---|
| 3,245,547 | 4/1966 | Felkay | 248/220.41 |
| 3,645,485 | 2/1972 | Gold | 248/220.41 |
| 4,058,220 | 11/1977 | Torongo | 211/57.1 |
| 4,217,986 | 8/1980 | Brown | 211/57.1 |
| 4,286,764 | 9/1981 | Pfiefer | 248/220.31 |
| 4,303,217 | 12/1981 | Garfinkle | 248/220.42 |
| 4,351,440 | 9/1982 | Thalenfield | 211/57.1 |
| 4,540,093 | 9/1985 | Merl et al. | 211/59.1 |
| 4,616,753 | 10/1986 | Aslan | 211/57.1 |
| 4,662,592 | 5/1987 | Garfinkle | 248/220.42 |
| 4,783,033 | 11/1988 | Valiulis | 211/59.1 |
| 4,801,116 | 1/1989 | Blankenship | 248/220.22 |
| 4,850,557 | 7/1989 | Valiulis | 211/59.1 |
| 4,869,376 | 9/1989 | Valiulis et al. | 211/59.1 |
| 5,080,238 | 1/1992 | Hochman | 211/59.1 |
| 5,236,163 | 8/1993 | Valiulis | 211/57.1 |
| 5,348,167 | 9/1994 | Jensen | 211/57.1 |
| 5,441,161 | 8/1995 | Merl | 211/57.1 |
| 5,485,929 | 1/1996 | Danon | 211/57.1 |
| 5,499,722 | 3/1996 | Goldring | 211/57.1 |
| 5,671,851 | 9/1997 | Johnson et al. | 211/57.1 |
| 5,887,731 | 3/1999 | Thalenfield | 211/57.1 |

*Primary Examiner*—Daniel P. Stodola
*Assistant Examiner*—Jennifer E. Novosad
*Attorney, Agent, or Firm*—Lackenbach Siegel Marzullo Aronson & Greenspan, P.C.

[57] ABSTRACT

A spacesaver product display hanger system includes long and short elongated members having different horizontally spaced information displays, and each product display has a hook for displaying and hanging product packages in a space saving manner while permitting conventionally sized and readable bar code product information on the product information displays. The display members or hangers are mounted with two long information display members immediately juxtaposed to each other with a short information display member disposed between and behind the two long information display members, so that the three hookloads of such product packages are disposed within the transverse horizontal space occupied by the two long information display members. The present system provides conventionally sized bar codes and other product description and pricing information, while providing three product displays in the space normally needed for at most two product package displays.

17 Claims, 2 Drawing Sheets

SPACESAVER PRODUCT DISPLAY HANGER SYSTEM

FIELD OF THE INVENTION

This invention relates to a product display hanger system. This invention also relates to a product display system wherein packaged products are removably displayed with associated product information juxtaposed to the packaged products.

BACKGROUND OF THE INVENTION

In point of purchase display or retail settings, products are blister packaged on cardboard and removably hanged from elongated horizontally extended prongs or hooks.

Typical prior art pronged packaged product hanger display systems are disclosed in: Valiulis, et al., U.S. Pat. No. 4,394,909, granted Jul. 9, 1983; Pfeifer, U.S. Pat. No. 4,286,764, granted Sep. 1, 1981; Valiulis, U.S. Pat. No. 4,850,557, granted Jul. 25, 1989; Valiulis, U.S. Pat. No. 4,783,033, granted Nov. 8, 1988; Barnes, U.S. Pat. No. 4,750,698, granted Jun. 14, 1988; Felkay, U.S. Pat. No. 3,245,547, granted Apr. 12, 1966; Larson, U.S. Pat. No. 5,580,017, granted Dec. 3, 1996; Taub, U.S. Pat. No. 4,583, 308, granted Apr. 22, 1986; Windish, U.S. Pat. No. 4,463, 510, granted Aug. 7, 1984; Thalenfeld, U.S. Pat. No. 4,351, 440, granted Sep. 28, 1982; Gold, U.S. Pat. No. 3,645,485, granted Feb. 29, 1972; Jensen, U.S. Pat. No. 5,348,167, granted Sep. 20, 1994; Fast, U.S. Pat. No. 4,665,639, granted May 19, 1987; Wood, U.S. Pat. No. 5,645,175, granted Jul. 8, 1997; Garfinkle, U.S. Pat. No. 4,303,217, granted Dec. 1, 1981; Fredrickson, U.S. Pat. No. 4,936,565, granted Jun. 26, 1990; Aslan, U.S. Pat. No. 4,616,753, granted Oct. 14, 1986; and Stucker, U.S. Pat. No. 4,027,799, granted Jun. 7, 1977.

The prior art product displays are often U-shaped members with one end having the elongated prong or hook for hanging the package and the other end having a mounting piece for holding a product information display card. The U-shaped display members were mounted to a wall or frame so that the elongated prongs or hooks and the information display extend horizontally forwardly to the point of purchase.

The product information display card necessarily contained product description and pricing information as well as bar code information required for inventory purposes. The product information, particularly including the bar code information, had to be of a certain minimum size for reading by a conventional bar code reader and or by the prospective purchaser. To economize on space, the U-shaped displays were mounted side-by-side with the minimal space therebetween. Where the packages were of considerable width, the width of the package dictated the minimum side-by-side spacing or space requirement. Where the packages were of small or limited width, the width of the product information cards determined the minimum side-by-side space utilization.

Small, relatively low cost, items were blister packaged on cards of less than 2 inches in width, and often no more than about 1 inch in width. The product information card width, however, at a minimum needed to be at least about 2 inches. This minimum card width was necessary to carry the requisitely sized bar code and purchaser information. Retailers were reluctant to display such low cost items because the point of purchase space allocation requirement to revenue ratio was prohibitively high. That is, more cost effective package products could be utilized in the always valuable retail space.

The product display art therefore desired a space efficient display for small packaged low cost items, while providing the requisitely juxtaposed minimally sized product information display.

SUMMARY OF THE INVENTION

A spacesaver product display system is provided for relatively small low cost packaged products which system includes a combination of short and long elongated U-shaped members with one end each of the similar sized U-shape having a hook for hanging the packaged product, and the other differently sized (long and short) end of the U-shape having a product information display. The product information display is in one aspect imprinted on a card which generally contains bar code information and prospective purchaser information, and which information is of readable size by a conventional bar code reader or respectively by the purchaser. In one aspect, two long U-shaped members are mounted with a short U-shaped member mounted between the long U-shaped members so that the short member product information card is disposed between and behind the immediately juxtaposed side-by-side long U-shaped members product information cards. The cards are, in one embodiment, angularly disposed for ease of reading all three product information cards, when juxtaposed in the aforesaid manner.

The system permits the mounting of three hookloads of small, i.e. less than 2 inches in width, blister packaged products in the minimum space previously occupied by two hookloads of such packages, to provide a one-third space savings for the retailer.

DESCRIPTION OF THE INVENTION

Figure 1:
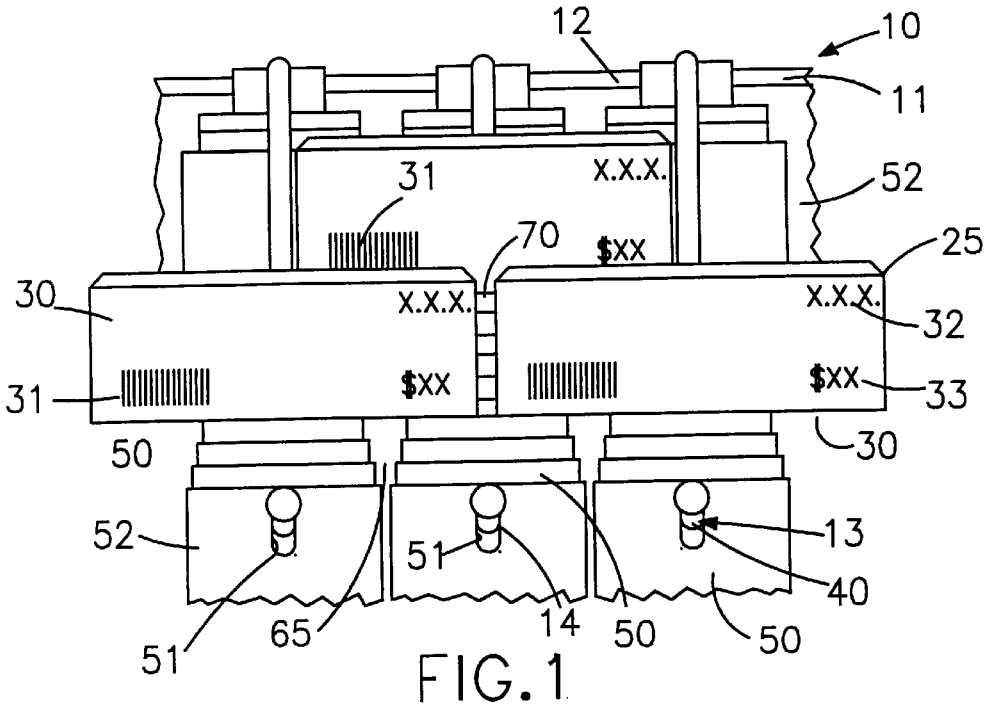
FIG. 1 is a front elevational view of the product display hanger system.

Referring to the FIGS., there is shown the spacesaver product package display hanger system 10. System 10 is mounted on a frame or bracket 11 which is mounted to a wall or support (not shown). Bracket 11 has a transversely disposed horizontal rib or slat 12 for holding U-shaped elongated members 13 (FIG. 3) and 14 (FIG. 4). U-shaped long member 13 and U-shaped short member 14 are similarly configured except as to the lengths of one of the elongated U-sides for reasons and purposes hereinafter appearing.

Figure 3:
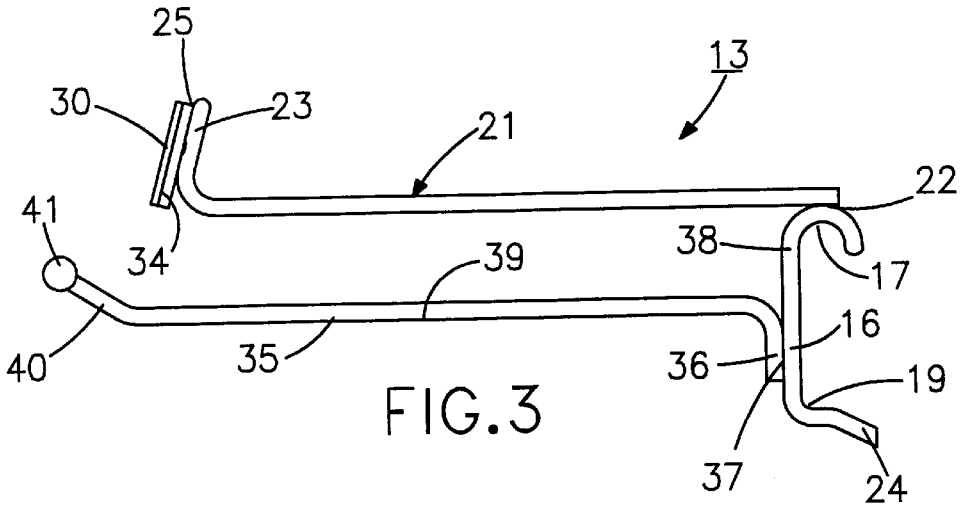
FIG. 3 is a side elevational view of a long product information display member.
Figure 4:
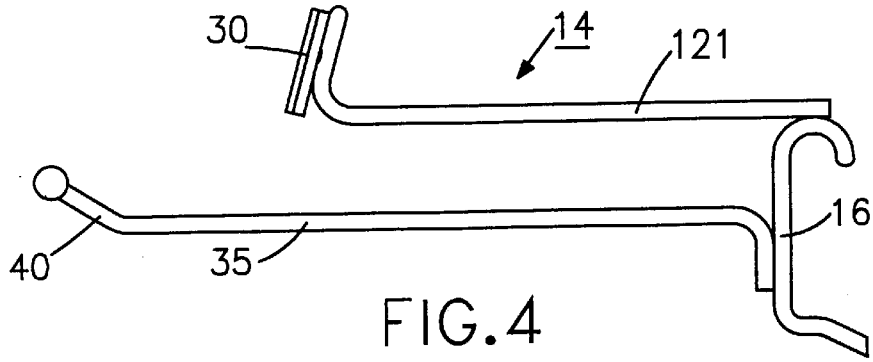
FIG. 4 is a side elevational view of a short product information display member.
Figure 2:
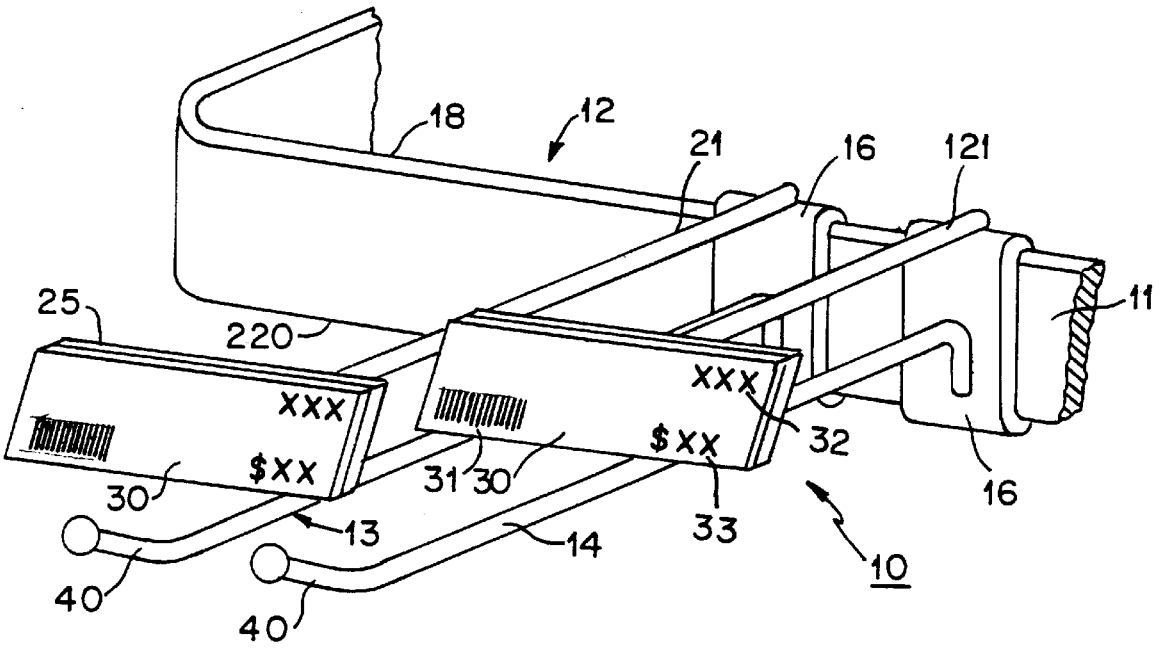
FIG. 2 is a perspective view of the system without the packaged products.

U-shaped long member 13 as best shown in FIG. 3, is formed with a metal spring clip 16. Clip 16 is sized to clip onto and slide on rib 12, with rounded sides 17 engaging the top 18 of rib 12 and L-shaped corner 19 at clip end 24 engaging the bottom 220 of rib 12. A top or upper elongated metal rod or prong 21 is welded to clip 16 at 22 so that prong 21 extends outwardly or forwardly away from bracket 11 and the rear wall (not shown). The front end of prong 21 is angled upwardly to about 60° to 75° to form front end portion 23. A rectangular metal plate 25 is welded or soldered to end portion 23. Plate 25 is formed to detachably receive card 30. Card 30 may also be formed with releasable adhesive on surface 34, for ready detachment.

Card 30 is an inventory control and product information card which necessarily contains bar code information 31 of a requisite size to be read by a conventional reader, product description information 32 and product pricing information 33 of a requisite size to be easily read by a prospective purchaser. Because of these product information display size requirements, card 30 is necessarily at least about 2 inches in transverse width and about ¾ inches in height. It is, as further discussed, the minimal width size of card 30 that dictates the minimum space requirement occupied by two equally sized juxtaposed U-shaped members.

U-shaped member 13 is also formed with a bottom or lower elongated U-shaped rod or prong 35. Prong 35 at its rear end is formed into a L-shaped end piece 36 which is soldered or welded at 37 to clip face 38 so that prong 35 extends outwardly and more forwardly than upper prong 21. Prong 35 at its forward end is formed with hook 40 which terminates a ball or spherical end piece 41. Hook 40 is angled at about 30° to 45° with respect to elongated portion 39 of prong 35.

Prong 35 and hook 40 are sized to hangedly receive blister packages 50 or more specifically the elongated top holes 51 formed in blister package card 52 as is well known in the art. It is important to note that the blister package cards 52 of the present invention are for small low cost products (not shown), and particularly so that the card width is no more than about 1 inch, as best shown in FIG. 1.

U-shaped member 14 is similar in construction to U-shaped member 13, having like clip 16, lower prong 35 and hook 40 elements. U-shaped member 14 differs from U-shaped member 13 in that upper prong 121 is about 1 to 1½ inches shorter than member 13 upper prong 21. It is this dimensional and structural difference that distinguishes member 13 from member 14.

In assembly, a long U-shaped member 13 is clipped onto rib 12 and then a short U-shaped member 14 is clipped onto rib 12 and moved along the rib to be adjacent to member 13 so that packages 50 or blister cards 52 are closely spaced with each other as at 65. A second long U-shaped 13 member is clipped onto rib 12 and slidably moved into position so that all packages or blister cards 52 are closely spaced, almost side-by-side touching, as shown at 65, and the product information display cards 35 are also closely spaced or near touching, as shown at 70.

Card 30 of member 14 is disposed behind and between cards 30 of adjacent member 13 and all the card 30 are angled so that a purchaser can view the product information of all three cards and the bar code information can be read from all three cards without having to move members 14 or 13.

Insofar as the approximate minimum width of cards 30 is at least about 2 inches, the overall utilized horizontal space occupied by two like immediately juxtaposed U-shaped display members 13 is in excess of 4 inches, and the maximum members of packages heretofore displayed in that maximum space is that carried on the two hookloads.

It has been found pursuant to the present invention that for small, low cost product packages having a blister package card width of about 1 inch or less, the array or system 10 using alternate long and short U-shaped members 13 and 14 permits three hookloads of packages to be displayed in the space previously allocated to two hookloads of packages. As a result there is a ⅓ increase in valuable retail display space utilization.

It will be understood, of course, that modifications can be made in the embodiment of the invention illustrated and described herein without departing from the scope and purview of the invention as defined by the appended claims.

What is claimed is:

1. A spacesaver package display hanger system comprising:

first and second elongated package display means for displaying pluralities of product packages adapted to be mounted to a support surface, each said package display means comprising hook means for removably hanging, a product package, and further comprising product information display means for displaying information relative to the product, said hook means and said information display means being vertically spaced;

third elongated package display means for displaying a further plurality of said product packages comprising hook means for removably hanging a product package, and further comprising third product information display means for displaying information relative to the product adapted to be mounted to said support surface, said third hook means and third product information display means being vertically spaced on said third package display means;

and wherein said third product information means is horizontally spacedly disposed along the third elongated package display means from said third hook means and said third product information means being more rearwardly disposed than said first and second product information display means;

the first and second package display means being arranged such that said product information display means are in horizontal juxtaposition, and said third package display means being arranged such that said third hook means disposed between said hook means of the first and the second package display means, the third product information display means is horizontally spacedly disposed from the first and second product information display means, and the first, second and third product information display means are viewable, and product packages can be removably displayed on each of said respective hook means within the space occupied by the horizontally juxtaposed product information display means of the first and second package display means.

2. The system of claim 1, further comprising mounting means for horizontally mounting each said package display means, and further comprising a plurality of product packages comprising means for removably hanging the product packages on each said hook means.

3. The system of claim 2, wherein each said information display means is disposed transversely to said respective elongated package display means, and wherein each information display means having a face which has a width and a height, with the face width transversely disposed relative to the elongated package display means and wherein each product package having a face which has a width and a height, with the package face width transversely disposed.

4. The system of claim 3, wherein the information display means face width is greater than the package face width.

5. The system of claim 3, wherein the information display means face width is at least twice the package face width.

6. The system of claim 5, wherein the information display means face width is about 2 inches and the package face width is about 1 inch.

7. The system of claim 6, wherein each said information display means further comprises a bar code.

8. The system of claim 3, wherein the faces of the first and second information display means are immediately juxtaposed to each other.

9. The system of claim 8, wherein the face of the third information display means is disposed behind the faces of the first and second information display means.

10. The system of claim 1, each said elongated package display means comprising a U-shape, and said hook means being formed at one end of the U-shape, and said information display means being disposed at the other end of the U-shape.

11. The system of claim 10, further comprising mounting means for horizontally mounting each said package display means, and further comprising a plurality of product packages, each said product package comprising means for removably hanging the package on each said hook means.

12. The system of claim 11, wherein each said information display means is disposed transversely to said product package, and wherein each said information display means has a face, which has a width and a height with the width being transversely disposed, and wherein each product package has a face, which has a width and a height, with the package face width transversely disposed.

13. The system of claim 12, wherein the faces of the first and second information display means are immediately juxtaposed to each other.

14. The system of claim 13, wherein each said information display means face being angularly disposed with respect to the horizontal.

15. The system of claim 14, wherein each said package comprising a cardboard blister package.

16. The system of claim 1, further comprising product packages having a width of no more than about 1 inch, and means for hanging the packages on each of the hook means.

17. The system of claim 1, wherein each of said information display means comprises scanner readable sized bar code information.

* * * * *